United States Patent [19]

Mortellite

[11] Patent Number: 4,523,620

[45] Date of Patent: Jun. 18, 1985

[54] WINDOW SHADE CLUTCH ASSEMBLY

[75] Inventor: Robert M. Mortellite, Hamilton, Ohio

[73] Assignee: Clopay Corporation, Cincinnati, Ohio

[21] Appl. No.: 458,439

[22] Filed: Jan. 17, 1983

[51] Int. Cl.[3] ..... E06B 9/208

[52] U.S. Cl. ..... 160/315

[58] Field of Search ..... 160/315, 309-311, 160/313, 314, 291, 294, 295, 298, 299

[56] References Cited

U.S. PATENT DOCUMENTS

| | | | |
|---|---|---|---|
| 350,656 | 10/1886 | Brooks . | |
| 823,452 | 6/1906 | Vickery . | |
| 873,438 | 12/1907 | John, Jr. . | |
| 982,444 | 1/1911 | Smith . | |
| 1,052,689 | 2/1913 | Pitman . | |
| 1,283,386 | 10/1918 | Wenzelmann . | |
| 1,502,197 | 7/1924 | Hill . | |
| 2,350,286 | 5/1944 | Michelman . | |
| 4,427,050 | 1/1984 | Toppen | 160/315 |
| 4,429,729 | 2/1984 | Winslow | 160/315 |

FOREIGN PATENT DOCUMENTS

| | | | |
|---|---|---|---|
| 2595 | of 1876 | United Kingdom | 160/299 |

*Primary Examiner*—Peter M. Caun
*Assistant Examiner*—Cherney S. Lieberman
*Attorney, Agent, or Firm*—Wood, Herron & Evans

[57] ABSTRACT

A combination window shade and clutch assembly is provided to prevent over-tensioning of the spring motor of the window shade. The clutch assembly includes spool means connected to one end of the spring motor and cup means, both movable along the window shade shaft. The spool means and cup means are provided with clutch means in the form of mating, tapered locking surfaces adapted to engage one another. The cup means engages retaining means formed in the rotatable housing of the window shade so that rotation of the housing is transmitted to the spool means through the cup means while their locking surfaces are in engagement. The clutch means interconnecting the cup means and spool means is operable to maintain engagement therebetween to permit tensioning of the spring motor a predetermined number of turns of the cup means and spool means together with window shade housing in one direction, and then is operable to disengage the cup means from the spool means to prevent additional tensioning of the spring motor without restricting further rotation of the housing in such one direction.

7 Claims, 3 Drawing Figures

WINDOW SHADE CLUTCH ASSEMBLY

FIELD OF THE INVENTION

This invention relates generally to the area of window shades, and, more particularly, to a clutch mechanism including clutch means operable to prevent over tensioning of the spring motor of the window shade to avoid potential failure.

BACKGROUND OF THE INVENTION

Devices for the protection of over tensioning in spring motors for window shades and other devices have been in use for many years. One common approach to this problem is found in various forms in U.S. Pat. Nos. 350,656 to Brooks, 823,452 to Vickery, 873,438 to John, and 982,444 to Smith. Each of these patents disclose some form of a nut or other internally threaded element which is movable along a threaded shaft in response to the rotation of the shaft. A spring is fixed to the shaft and is tensioned or unwound with the rotation thereof in a given direction. The nut is positioned on the shaft so that it will engage a stop at a predetermined point when the desired number of turns of the shaft is reached. This predetermined point is made to correspond to the maximum tension which can be imposed on the spring motor without damage. Once the designated number of rotations is reached, further rotation of the shaft is prevented by engagement of the nut or other movable member with the stop.

Another approach is found in U.S. Pat. No. 1,052,689 to Pitman. In this patent, an elongated shaft is provided having a threaded portion at one end and an attachment means at the other end. A spring, acting as the motor for the window shade, is secured to the attachment means of the elongated shaft. A drum having internal threads is disposed along the threaded portion of the shaft and movable axially therealong in response to rotation of the shaft. The other end of the spring is attached to the drum, and thus, movement of the drum in one direction will cause the spring to tension and in the other direction to unwind. Means are provided to engage the drum and prevents its axial movement after a desired number of rotations of the shaft so as to provide a fixed stop to prevent the spring motor from being tensioned beyond a predetermined amount.

One limitation of each of the devices described above is that they are rather bulky in configuration and may not be readily adapted to the streamlined tubes which house modern day window shade devices. In addition, each of these over tensioning means provides a fixed stop which restricts the shaft from any further rotation in the direction in which the spring is tensioned. It is contemplated that this could present a practical problem in the use of window shades embodying such devices, particularly by those not familiar with their operation. Once the point where the stop engages is reached, the user could inadvertently pull further on the shade and create severe damage to the entire window shade assembly.

A solution to this problem is disclosed in U.S. patent application Ser. Nos. 396,649 filed July 9, 1982 and 401,832 filed July 26, 1982, both entitled Window Shade Clutch Assembly, and both assigned to the same assignee as this invention. These inventions each disclose a clutch assembly having clutch means operable to limit the amount of tensioning of the spring motor without providing a fixed stop. The clutch assemblies of such inventions are adapted for use with window shades having a rotatable housing, a fixed, threaded shaft and a spring motor attached at one end to the fixed shaft. The clutch assemblies generally include sleeve means, attached to the spring motor, which is adapted to move axially along the fixed shaft in a first and second direction. Connecting means are provided to connect the sleeve means to the housing for rotation therewith, which rotation causes the sleeve means to move axially along the fixed shaft. Movement of the sleeve means in one axial direction along the shaft, in response to rotation of the housing in a first direction, causes increased tensioning of the spring motor.

In order to prevent over-tensioning of the spring motor, clutch means is provided in each of the inventions which comprises a locking element formed in the sleeve means and a mating locking element formed in the connecting means. At a predetermined point of axial movement of the sleeve means along the shaft, the clutch means operates to disengage the locking element of the sleeve means from the mating locking element of the connecting means for up to one revolution of the housing in such first direction. Immediately thereafter, the fully tensioned spring motor which is attached to the sleeve means, operates to rotate the sleeve means in the opposite direction of such first direction for re-engagement with the connecting means. Further rotation of the housing in the first direction results in alternating disengagement and engagement of the sleeve means locking element with the locking element of the connecting means, which prevents additional tensioning of the spring motor while allowing the housing to continue to be rotated in such first direction.

The spring motors utilized in window shades to produce satisfactory performance impose a relatively high amount of torque on the sleeve means and connecting means of such clutch assemblies, particularly in re-engaging the sleeve means with the connecting means once the clutch means operates to disengage them. In the single or half revolution of the sleeve means which occurs before it re-engages the connecting means, the sleeve means builds up a significant amount of momentum due to the relatively high torsional force imposed through its connection to the spring motor. Therefore, the locking element of the sleeve means contacts the locking element of the connecting means with a relatively high impact force. Repeated contact between such locking elements at such high impact levels can produce wear of the locking elements of these prior designs unless hardened materials are used in their fabrication such as glass-filled Nylon. These materials add to the cost of the window shade.

SUMMARY OF THE INVENTION

It is among the primary objects of this invention to provide a clutch assembly which can be fabricated from relatively inexpensive materials and yet exhibit long useful life, for use in combination with a window shade having a rotatable housing, a fixed shaft disposed longitudinally within the housing, and a spring motor attached to one end of the shaft. The window shade clutch assembly includes a spool means consisting of a sleeve disposed between and attaching to a nut and an end plate. The other end of the spring motor attaches to the end plate of the spool means. An axial bore extends through the nut, end plate and sleeve and is formed with internal threads along the length of the nut and sleeve.

The sleeve threads are engageable with external threads formed along at least a portion of the length of the shaft so as to permit axial movement of the spool means along the shaft in opposite directions. A cup means is disposed along the sleeve of the spool means between the nut and end plate, and is urged into engagement with the nut by a compression spring disposed between the end plate and cup. The cup is formed with at least one groove in its outer edge which engages a lip extending downwardly from the interior wall of the window shade housing. This connection between the cup means and housing enables the cup means to rotate with the housing in a first and second direction.

The outer surface of the nut of the spool means and the inner surface of the cup means are formed with mating tapered surfaces which are self-locking, at least to some degree, so as to permit rotation of the spool means with the housing through the locking connection between the cup means and the spool means. As discussed in detail below, the tapered surfaces of the nut and cup means are subjected to limited impact forces as they engage one another during the operation of the clutch assembly herein which minimizes the wear of such surfaces and extends the life of the clutch assembly herein.

The inner tapered surface of the cup means is operable to maintain engagement with the outer tapered surface of the nut of the spool means due to the compression force exerted by the compression spring so as to permit rotation of the spool means relative to the fixed shaft a predetermined number of turns of the housing in a clockwise direction. Since one end of the spring motor is rotating with the spool means and housing but the other end is held from rotation by its connection to the fixed shaft, the spring motor is tensioned by such clockwise rotation of the housing. In addition, during such rotation, the spool means and cup means move axially along the shaft due to the threaded engagement between the spool sleeve and shaft.

Once a predetermined number of revolutions of the spool means is reached, corresponding to the preferred tension which may safely be applied to the spring motor, outwardly extending edges of the cup means engage a fixed stop mounted to the interior of the tube. Further axial movement of the cup means is prevented. Continued clockwise rotation of the tube moves the spool means axially relative to the now fixed cup means causing the tapered surface of the nut of the spool means to briefly disengage from the tapered surface of the cup means. Due to the configuration of the mating tapered surfaces of the spool means and cup means as discussed in detail below, almost simultaneously upon disengagement of the tapered surfaces of the spool means and cup means, the tensioned spring motor causes the spool means to rotate in a counter-clockwise direction moving its tapered surface axially in the reverse direction and into engagement with the mating tapered surface of the cup means.

Further clockwise rotation of the housing results in a continuation of this alternating disengagement and engagement of the cup means and spool means tapered surfaces, thus permitting no further overall clockwise rotation of the spool means relative to the fixed shaft. As discussed below, the configuration of such tapered surfaces limits the extent and amount of disengagement between the cup means and spool means so as to reduce impact forces therebetween upon re-engagement. The operation of the clutch assembly herein thus protects the spring motor against over-tensioning while providing an assembly operable to reduce wear and increase operating life.

DESCRIPTION OF THE DRAWINGS

The structure, operation and advantages of this invention will become apparent upon consideration of the following discussion taken in conjunction with the accompanying drawings, wherein.

DESCRIPTION OF THE INVENTION

Figure 1:
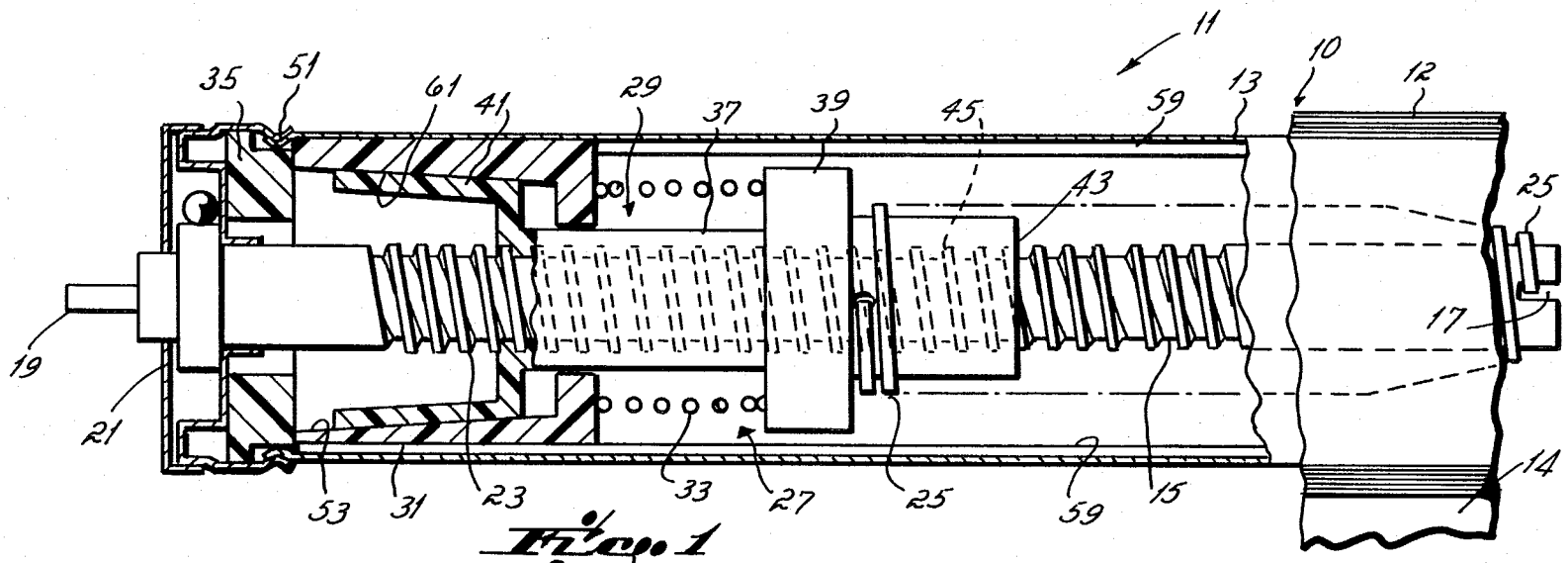
FIG. 1 is a partial front view in partial cross-section of a window shade showing the clutch assembly of this invention in a locked position.
Figure 2:
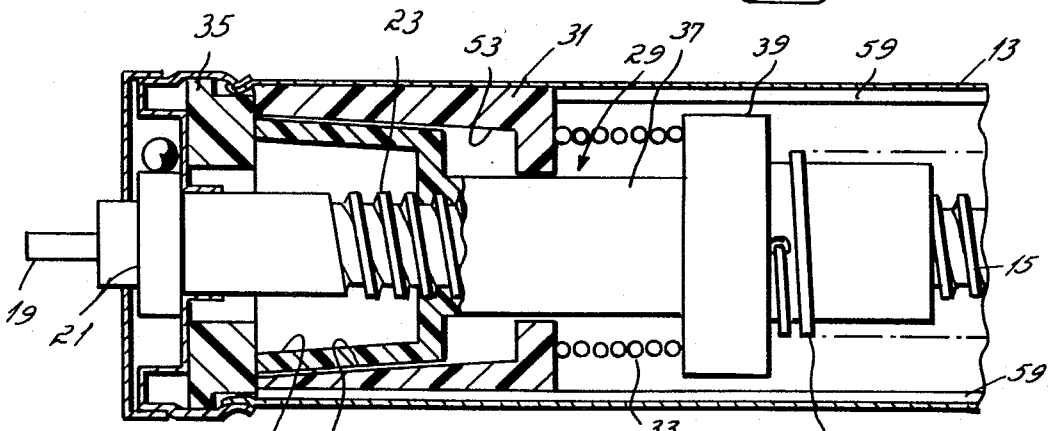
FIG. 2 is a partial front view in partial cross-section of a window shade in which the clutch assembly of this invention is shown in an unlocked position.

Referring now to the drawings and in particular to FIGS. 1 and 2, a preferred embodiment of the clutch assembly of this invention is illustrated. Although one type of window shade 11 is shown in combination with the clutch assembly, it should be understood that other types of window shades such as a flush mount motor window shades may be utilized. Window shade 11 includes a rotatable tube assembly or housing 10 including an outer tube 12 and an inner tube 13 in which an elongated shaft 15 is longitudinally disposed. The shaft 15 is formed with a slot 17 at one end and a spear 19 at the other end with the spear extending through an end cap 21 as shown. The spear 19 engages one of two mounting brackets (not shown) which support the window shade and prevent the shaft 15 from rotating within tube assembly 10. The shaft 15 is formed with external threads 23 along at least a portion of its length adjacent the end having spear 19. The slotted end 17 of shaft 15 is attached to a torsion spring motor 25 which is concentrically disposed over shaft 15 along at least a portion of its length. The other end of the spring motor 25 is attached for rotation to the clutch assembly of this invention, which in turn is rotatable with tube 13 as discussed in detail below.

In operating window shade 11, the spring motor 25 is first tensioned as the fabric portion 14 of the window shade 11 is moved downwardly, and then unwinds to move the fabric portion 14 upwardly and around the outer tube 12. The tube 13 is rotatable first in one direction and then in the opposite direction as the fabric portion 14 of the window shade 11 is raised and lowered. Although not shown in the drawings, catch means are provided to stop the rotation of tube 13 so as to position the fabric portion 14 of window shade 11 as desired. Since upward movement of the window shade 11 is dependent upon the rotation of tube 13 induced by unwinding of spring motor 25, it is crucial to the operation of window shade 11 that the spring motor 25 be protected from damage due to over tensioning. Although positive stops have been proposed to protect the spring motor such as disclosed in the prior art mentioned above, such devices have been found to inadequately solve the problem.

The clutch assembly of this invention is labeled generally with the reference numeral 27. The primary elements of the clutch assembly 27 include a spool 29, a cup 31, a retaining compression spring 33 and clutch means acting between the spool 29 and cup 31. The spool 29 consists of a sleeve 37 disposed between and attaching to an end plate 39 and a nut 41. The other end of the spring motor 25 is attached to end plate 39. An axial bore 43 extends through the sleeve 37, nut 41 and end plate 39, and includes threads 45 formed along the sleeve 37 and nut 41 which are engageable with the external threads 23 of shaft 15. As discussed below, the spool 29 is axially movable along shaft 15 due to the engagement of the interior threads 45 of sleeve 37 and nut 41 and the external threads 23 of shaft 15.

Figure 3:
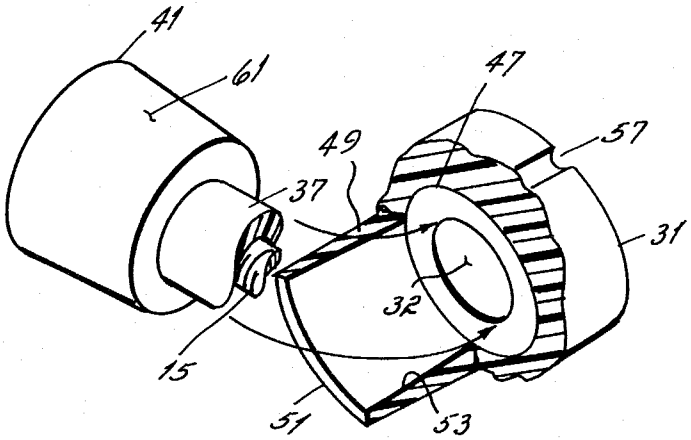
FIG. 3 is an exploded view in partial cross-section of the tapered surfaces forming a portion of the clutch means of the clutch assembly herein.

As shown in FIGS. 1 and 3, the cup 31 is generally cylindrical in shape and includes a central bore 32 having a larger diameter than sleeve 37 so as to permit the cup 31 to be disposed on the sleeve 37 of spool 29. A larger bore or opening 47 is also formed in cup 31 which tapers outwardly or increases in diameter from the central bore 32 to the forward end 51 of cup 31 which extends outwardly over the nut 41. The bore 47 forms a generally frusto-conically shaped wall 49 in cup 31 thus providing an inner tapered surface 53 which faces inwardly toward shaft 15. As discussed below, the tapered surface 53 is preferably formed with an included angle or an angle of taper in the range of approximately 6°–10° in one preferred embodiment of this invention. A pair of grooves 57 are formed in the exterior surface of the outer wall 49 of cup 31 which engage lip sections 59 formed in the interior surface of the tube 13. Therefore, by the connection of lip sections 59 with grooves 57, the rotation of tube 13 is transferred to the cup 31. Although two grooves 57 and lip sections 59 are shown in the drawings, it should be understood that other numbers of grooves and lip sections could be utilized to transfer the rotation of the tube 13 to the cup 31.

As shown in FIG. 3, the nut 41 is formed in a frusto-conical shape with an outer tapered surface 61 extending outwardly from shaft 15 having an angle of taper, in one preferred embodiment of this invention, of approximately 6°–10°. The nut 41 is sized to extend upwardly from shaft 15 such that its tapered surface 61 engages the tapered surface 53 of cup 31. The tapered surfaces 53, 61 of the cup 31 and nut 41, respectively, are urged into engagement by the retaining compression spring 33 which is disposed between the end plate 39 and cup 31. The retaining compression spring 33 continually forces cup 31 toward nut 41 to aid in maintaining engagement between their tapered surfaces 53, 61. Rotation of the tube 13 is thus transferred by the cup 31 to spool 29 through the locking engagement between the tapered surfaces 53, 61 of cup 31 and nut 41.

As mentioned above, it is necessary for the proper operation of window shade 11 to protect spring motor 25 from damage due to over-tensioning. The purpose of clutch assembly 27 is to prevent such over-tensioning without providing a positive stop or a point at which no further rotation of the tube 13 can occur. The advantages and operation of the clutch assembly 27 herein, which accomplishes this function, may be better appreciated by considering a lowering and raising operation of window shade 11.

As the fabric portion 14 of window shade 11 is first lowered, the tube 13 rotates in a clockwise direction as viewed from the right side of the figures according to the configuration of window shade 11 shown. Initially, the spool 29 and cup 31 are positioned along shaft 15 such that the tapered surfaces 53, 61 of cup 31 and nut 41, respectively, are maintained in continuous engagement by the retaining compression spring 33. Due to the connection of the grooves 57 of cup 31 with the lip sections 59 of tube 13, the cup 31 and spool 29 rotate in a clockwise direction with the tube 13 as the fabric portion 14 of the window shade 11 is lowered. Since one end of the spring motor 25 is connected to the fixed shaft 15 and the other end to the rotating end plate 39 of spool 29, the spring motor 25 is tensioned as the tube 13, cup 31 and spool 29 are rotated in a clockwise direction. During this clockwise rotation of tube 13, the spool 29 moves axially along the fixed shaft 15 toward its spear end 19 due to the engagement of the internal threads 45 of the spool sleeve 37 and nut 41 with the external threads 23 of shaft 15. The cup 31 is carried by the spool 29 in the same axial direction, with the grooves 57 in the cup 31 maintaining engagement with the lip sections 59 of tube 13 throughout the axial movement along shaft 15.

Referring now to FIGS. 1 and 2, it can be seen that tensioning of the spring motor 25 continues so long as the tapered surfaces 53, 61 of the cup 31 and nut 41 maintain engagement with one another, allowing the spool 29 to rotate with cup 31. In turn, tensioning of spring motor 25 ceases when the spool 29 is restrained from further overall rotation in the clockwise direction.

Clockwise rotation of spool 29 with tube 13 is restrained as follows. In FIG. 1, the outwardly extending edge 51 of the annular wall 49 of cup 31 is shown making initial engagement with a stop 35 concentrically mounted within the interior of tube 13 adjacent the spear end 19 of shaft 15. Although shown adjacent the spear end 19 of shaft 15, stop 35 could be fixed at other locations along tube 13 for purposes to become apparent below. Axial movement of the cup 31 with spool 29 along shaft 15 is permitted until the edge 51 of cup 31 contacts the stop 35. At this point, axial movement of the cup 31 is prevented.

Further clockwise rotation of tube 13 is transferred by cup 31 to the spool 29 causing the spool 29 to continue to move axially relative to the cup 31 toward the spear end 19 of shaft 15, while the cup 31 is restrained from such further axial movement by stop 35. As discussed in more detail below, the tapered surfaces 53, 61 of the nut 41 and cup 31, respectively, are formed with an angle of taper which requires a relatively small axial force to effect disengagement between the spool 29 and cup 31. Therefore the nut 41 of spool 29 readily disengages from the cup 31 when the edge 51 of cup 31 contacts stop 35. Once the tapered surfaces 53, 61 are disengaged, the tensioned spring motor 25, through its connection to first end plate 39, rotates spool 29 in a counter-clockwise direction. This causes spool 29 to move axially in the opposite direction along shaft 15 so that the tapered surface 53 of nut 41 re-engages the mating tapered surface 61 of cup 31. Further clockwise rotation of tube 13 at this point causes repeated disengagement and engagement of tapered surfaces 53, 61, which act as a clutch means to affect relative rotation between the cup 31 and spool 29.

Due to the configuration of tapered surfaces 53, 61, such alternate disengagement and engagement therebetween occurs virtually simultaneously. Immediately upon disengagement of tapered surfaces 53, 61, the spring motor 25, which is fully tensioned, operates to re-engage surfaces 53, 61. There is an extremely small amount of relative rotation between tapered surface 53, 61 before re-engagement occurs because such surfaces inherently enage at any point of relative rotation or orientation. In contrast to prior devices, no positive stop or locking device on either surface 53, 61 is required to effect engagement therebetween and thus such surfaces 53, 61 need not be rotated to any particular orientation or position to achieve locking engagement. Since the amount of rotation between the nut 41 of spool 29 and cup 31 upon disengagement is minimal before their tapered surfaces 53, 61 re-engage, limited momentum is developed in spool 29 by spring motor 25. Therefore the impact between spool 29 and cup 31 is minimal.

As mentioned above, a disadvantage of prior art designs is that upon disengagement of the clutch assembly locking means, the member disposed along the fixed shaft is allowed to be rotated by the spring motor up to a full revolution before re-engagement with the member connected to the window shade tube. In that one revolution or half revolution, using spring motors of conventional stiffness, it was found that the momentum developed between the two members can result in undue wear to their locking means unless hardened materials are used in the fabrication of such locking means such as glass-filled Nylon. The advantage provided by the tapered surfaces 53, 61 herein is therefore the significant reduction in relative rotation permitted between the spool 29 and cup 31 upon disengagement and before re-engagement, which, in turn, reduces the impact force between such surfaces. Accordingly, the useful life of the window shade clutch assembly 27 herein is increased without the use of more expensive hardened materials in fabricating the tapered surfaces 53, 61.

The spring motor 25 is thus protected from overtensioning because further net clockwise rotation of the spool 29 is prevented, except for a fraction of a revolution thereof as the tapered surfaces 53, 61 disengage, once the spool 29 and cup 31 move axially along shaft 15 to the point where the edge 51 of cup 31 engages stop 35. The spring motor 25 cannot be tensioned further at such point because neither of its ends is being rotated in a clockwise direction relative to the other for more than a fraction of a revolution of spool 29.

The angle of taper of the tapered surfaces 53, 61 and the compression spring force of the retaining compression spring 33 must be chosen properly to assure the transmission of torque between cup 31 and spool 29, without requiring a high axial force to separate such surfaces 53, 61 at the point of maximum tension of spring motor 25. It has been found that the tapered surfaces 53, 61 may be formed with a relatively wide range of angles of taper, provided that a retaining compression spring 33 is chosen which provides a sufficient compression spring force to maintain the tapered surfaces 53, 61 in engagement at the levels of torque applied thereto by the spring motor 25. Generally, the higher the angle of taper of tapered surfaces 53, 61, the greater the compression spring force required to maintain them in engagement at a given torque.

For example, one embodiment of the window shade 11 herein requires that the spool 29 transmit a torsional force applied by the spring motor 25 to the cup 31, and in turn housing 13, of approximately 2.75 inch-pounds to assure proper winding of fabric portion 14 on the tube assembly 10. Assuming tapered surfaces 53, 61 are each formed with an angle of taper of about 2°–3°, a retaining compression spring 33 capable of applying a compression spring force of about 2–3 pounds should be disposed between the cup 31 and end plate 39 to enable tapered surfaces 53, 61 to transmit 2.75 inch-pounds of torque therebetween. Tapered surfaces 53, 61 formed with an angle of taper on the order of 30° require a retaining compression spring 33 to exert a compression spring force of about 10–12 pounds so that 2.75 inch-pounds of torsional force can be transmitted therebetween. These values for the spring force exerted by retaining compression spring 33 at different angles of taper of surfaces 53, 61 were determined for tapered surfaces 53, 61 each formed of styrene, for purposes of illustration. It is contemplated that one of the tapered surfaces 53, 61 may be formed of polystyrene and the other polypropylene in other embodiments of this invention, which materials would generally increase the compression force required to maintain tapered surfaces 53, 61 in engagement due to their lesser coefficients of friction.

Retaining compression springs 33 may be provided having a variety of compression spring rates, which allow tapered surfaces 53, 61 to be formed within a wide range of angles of taper. It has been found, however, that while some angles of taper are workable, there are limitations created which make other angles of taper more desirable. For example, tapered surfaces 53, 61 formed with an angle of taper in the range of 2°–4° require a relatively high axial force to effect disengagement. It is preferred that the tapered surfaces 53, 61 readily disengage at the point of maximum tensioning of spring motor 25 to assure smooth operation of the clutch assembly 27. While the problem of disengagement is avoided by forming tapered surfaces 53, 61 with an angle of taper of 30° or more, the compression spring force required to maintain tapered surfaces 53, 61 in engagement at such angles is relatively high.

It is believed that efficient operation of a production version of window shade 11 may be achieved by forming tapered surfaces 53, 61 with an angle of taper preferably in the range of about 6°–10°. Tapered surfaces 53, 61 having an angle of taper in this range have proved to operate effectively with the tapered surfaces 53, 61 exhibiting good torque transmitting capability without requiring high axial forces to effect disengagement, while using a retaining compression spring 33 with a relatively low compression spring force. Although angles of taper in the 6°–10° range are desirable, it should be understood in accordance with the above discussion that other angles of taper in combination with suitable spring motors 25 and retaining compression springs 33 may be employed herein to effectively wind the fabric portion 14 of window shade 11 on tube assembly 10.

The amount of tension which the spring motor 25 is allowed to receive is controlled and can be adjusted to accommodate springs of different ultimate tension. As discussed above, the spring motor 25 is tensioned by the rotation of spool 29 with tube 13 through the connection between cup 31, since one end of the spring motor 25 is attached to the rotatable end plate 39 and the other to the fixed shaft 15. This tensioning continues until the cup 31, moving axially along shaft 15 with spool 29, engages the stop 35 at which point the nut 41 and cup 31 alternately disengage and engage as discussed above. The axial length of travel of spool 29 and cup 31 along the shaft 15 to this point of disengagement or release is fixed according to the tension which may preferably be applied to spring motor 25 in accordance with manufacturers' specifications or other design criteria.

For a spring motor 25 capable of accepting a given amount of tension, the spool sleeve 37 and end nut 41 are initially threaded onto the shaft 15 to dispose the outer edge 51 of cup 31 an appropriate axial distance from stop 35. This axial distance may also be expressed in terms of the number of revolutions of spool sleeve 37 and nut 41 which are necessary to move the spool 29 and cup 31 to the correct axial position along shaft 15. Although stop 35 is shown in the drawings adjacent to spear end 19 of shaft 15, the position of stop 35 may be altered to adjust the axial distance between it and spool 29. Regardless of the tension permitted for various spring motors 25, the spool 29 and cup 31 can be positioned at the proper axial distance from the stop 35 so that when tube 13 is rotated in a clockwise direction the spool 29 will rotate only those number of turns needed to obtain the correct tension on spring motor 25 and then reach the point where cup 31 engages stop 35 where no further tensioning of spring motor 25 can occur.

Allowing the fabric portion 14 of the window shade 11 to move upwardly and wrap around tube 12 enables the spring motor 25 to unwind, which in turn causes the tube 13 to rotate in a counter-clockwise direction through the connection between spool 29 and cup 31. As they rotate counter-clockwise with tube 13, the spool 29 and cup 31 move axially toward the slotted end 17 of shaft 15 to assume their original position along shaft 15 in preparation for another lowering and raising operation.

Although the invention has been described in terms of a certain preferred embodiment, persons skilled in the art to which this invention pertains will readily appreciate modifications and changes which may be made without departing from the spirit of the invention. Therefore, I do not intend to be limited except by the scope of the appended claims.

Thus having described the invention, what is claimed is:

1. A tube assembly for preventing over-tensioning of a spring motor means in a window shade comprising:

a fixed shaft;

a housing rotatable relative to said fixed shaft;

spring motor means contained within said housing, said spring motor means being connected to said fixed shaft;

spool means axially movable along said fixed shaft, said spool means being connected to said spring motor means;

cup means rotatable with said housing;

clutch means including a first tapered surface formed in said spool means and a second tapered surface formed in said cup means, said first and second tapered surfaces of said clutch means being adapted to mate to permit rotation of said spool means with said cup means and housing;

said spool means being movable in a first axial direction along said shaft while rotating with said cup means and housing to effect increased tensioning of said spring motor means, said first and second tapered surfaces of said clutch means being operable to disengage said spool means from said cup means at a predetermined point of axial movement of said spool means in said first direction to prevent further tensioning of said spring motor means.

2. The assembly of claim 1 wherein said first tapered surface is formed with an angle of taper in the range of approximately 6°–10°.

3. The assembly of claim 1 wherein said second tapered surface is formed with an angle of taper in the range of approximately 6°–10°.

4. A tube assembly for preventing over-tensioning of a spring motor means in a window shade comprising:

a fixed shaft;

a housing rotatable relative to said fixed shaft;

spring motor means contained within said housing, said spring motor means being connected to said fixed shaft;

spool means axially movable along said fixed shaft, said spool means being connected to said spring motor means;

cup means rotatable with said housing;

clutch means including a first tapered surface formed in said spool means, and a second tapered surface formed in said cup means, said first and second tapered surfaces of said clutch means being adapted to mate to permit rotation of said spool means with said cup means and housing in a first and second direction;

said spool means and said cup means moving axially in one direction along said shaft and rotating with said housing as said housing rotates in said first direction while said first and second tapered surfaces of said clutch means maintain continuous engagement for tensioning said spring motor means;

stop means disposed at a first location within said housing, said stop means engaging said cup means at said first location to prevent further axial movement thereof along said shaft in said one direction;

said first and second tapered surfaces of said clutch means being operable to alternately disengage and engage one another when said cup means contacts said stop means to prevent further rotation of said spool means with said housing in said first direction for avoiding further tensioning of said spring motor means;

said first and second tapered surfaces of said clutch means being operable to maintain engagement as said housing rotates in said second direction, said spool means and said cup means moving axially in the opposite direction of said one direction with the tension on said spring motor means being released as said housing rotates in said second direction and said spool means and cup means move along said shaft in said opposite direction.

5. The assembly of claim 4 wherein said first tapered surface is formed with an angle of taper in the range of approximately 6°–10°.

6. The assembly of claim 4 wherein said second tapered surface is formed with a angle of taper in the range of approximately 6°–10°.

7. A tube assembly for preventing over-tensioning of a spring motor means in a window shade comprising:

a fixed shaft formed with external threads along at least a portion of the length thereof;

a housing rotatable relative to said fixed shaft;

engaging means associated with said housing;

spring motor means contained within said housing, said spring motor means being connected to said fixed shaft;

spool means having a sleeve disposed between and attaching to a nut and an end plate, said sleeve, nut and end plate having a common axial bore therethrough formed with internal threads for engagement with said exterior threads of said shaft for axial movement of said spool means along said shaft, said spring motor means attaching to said end plate;

cup means disposed along said sleeve of said spool means between said nut and said end plate and movable therewith along said shaft, said cup means being captively disposed within said engaging means of said housing for rotation of said cup means with said housing;

clutch means including a first tapered surface formed in said nut with an angle of taper in the range of approximately 6°–10°, and a second tapered surface formed in said cup with an angle of taper in the range of approximately 6°–10°, said first and second tapered surfaces being adapted to mate to permit rotation of said spool means with said cup means and housing;

spring retaining means disposed between said end plate and said cup means for urging said second tapered surface of said cup means into engagement with said first tapered surface of said nut of said spool means to permit rotation of said spool means with said cup means and in turn said housing in a first and second direction;

said spool means and said cup means moving axially in one direction along said shaft and rotating with said housing as said housing rotates in said first direction while said first and second tapered surfaces are maintained in continuous engagement by said spring retaining means for tensioning said spring motor means;

stop means disposed at a first location within said housing, said stop means engaging said cup means at said first location to prevent further axial movement thereof along said shaft in said one direction;

said first tapered surface of said nut of said spool means and said second tapered surface of cup means being operable to alternately disengage and engage one another when said cup means contacts said stop means to prevent further overall rotation of said spool means with said cup means and housing in said first direction for avoiding further tensioning of said spring motor means;

said first and second tapered surfaces being operable to engage one another as said housing rotates in said second direction, said spool means and said cup means moving axially in the opposite direction of said one direction with the tension on said spring motor means being released as said housing rotates in said second direction and said spool means and cup means move along said shaft in said opposite direction.

* * * * *